US007784130B2

(12) United States Patent
Pile

(10) Patent No.: US 7,784,130 B2
(45) Date of Patent: Aug. 31, 2010

(54) ALTERNATING PRESSURE MATTRESSES

(75) Inventor: Brian F. Pile, Fareham (GB)

(73) Assignee: Pegasus Limited (GB)

( * ) Notice: Subject to any disclaimer, the term of this patent is extended or adjusted under 35 U.S.C. 154(b) by 447 days.

(21) Appl. No.: 11/815,994

(22) PCT Filed: Feb. 14, 2006

(86) PCT No.: PCT/GB2006/000530

§ 371 (c)(1),
(2), (4) Date: Aug. 10, 2007

(87) PCT Pub. No.: WO2006/085109

PCT Pub. Date: Aug. 17, 2006

(65) Prior Publication Data

US 2008/0271253 A1 Nov. 6, 2008

(30) Foreign Application Priority Data

Feb. 14, 2005 (GB) ..... 0503050.7
Sep. 6, 2005 (GB) ..... 0518118.5

(51) Int. Cl.
*A47C 27/10* (2006.01)

(52) U.S. Cl. ..... 5/713; 5/710

(58) Field of Classification Search ..... 5/713, 5/710, 706, 644, 654, 655.3
See application file for complete search history.

(56) References Cited

U.S. PATENT DOCUMENTS 2,245,909 A * 6/1941 Enfiajian ..... 5/710
2,719,986 A * 10/1955 Rand ..... 5/713
3,148,391 A * 9/1964 Whitney ..... 5/422
3,390,674 A * 7/1968 Jones ..... 601/150
3,674,019 A * 7/1972 Grant ..... 601/148
3,678,520 A * 7/1972 Evans ..... 5/713
3,701,173 A * 10/1972 Whitney ..... 5/713
4,175,297 A * 11/1979 Robbins et al. ..... 5/284
4,225,989 A * 10/1980 Corbett et al. ..... 5/713
4,267,611 A * 5/1981 Agulnick ..... 5/713
4,280,487 A * 7/1981 Jackson ..... 601/150
4,347,633 A * 9/1982 Gammons et al. ..... 5/713
4,391,009 A * 7/1983 Schild et al. ..... 5/713

(Continued)

FOREIGN PATENT DOCUMENTS

DE 29 19 438 A1 11/1980

(Continued)

*Primary Examiner*—Robert G Santos
(74) *Attorney, Agent, or Firm*—Craig A. Fieschko, Esq.; DeWitt Ross & Stevens S.C.

(57) ABSTRACT

An alternating pressure mattress has two sets (A, B) of cells, which are inflated and deflated cyclically and in sequence, to provide alternating support for a patient. Each set (A, B) has central transverse cells (11*a*, 11*b*) and side forming cells (14*a*, 14*b*). The central cells (11*a*, 11*b*) provide a central region for the patient. The side forming cells (14*a*, 14*b*) protrude, when inflated, higher than the central cells, to act as side barriers preventing rolling of the patient off the mattress. At each side of the mattress a plurality of the side forming cells (14*a*, 14*b*) of both sets (A, B) is present, these cells inflating and deflating with the respective central cells (11*a*, 11*b*), so that the side barrier effect is provided by the two sets (A, B) cells alternatingly.

11 Claims, 8 Drawing Sheets

U.S. PATENT DOCUMENTS

| | | | | | |
|---|---|---|---|---|---|
| 4,472,847 | A * | 9/1984 | Gammons et al. | 5/713 |
| 4,617,690 | A * | 10/1986 | Grebe | 5/713 |
| 4,653,130 | A * | 3/1987 | Senoue et al. | 5/713 |
| 4,825,486 | A * | 5/1989 | Kimura et al. | 5/713 |
| 5,035,016 | A * | 7/1991 | Mori et al. | 5/713 |
| 5,103,518 | A * | 4/1992 | Gilroy et al. | 5/713 |
| 5,189,742 | A * | 3/1993 | Schild | 5/713 |
| 5,243,723 | A * | 9/1993 | Cotner et al. | 5/710 |
| 5,396,671 | A * | 3/1995 | Stacy | 5/655.3 |
| 5,678,265 | A * | 10/1997 | Meyer | 5/654 |
| 5,729,853 | A * | 3/1998 | Thompson | 5/713 |
| 5,755,000 | A * | 5/1998 | Thompson | 5/713 |
| 5,901,393 | A * | 5/1999 | Pepe et al. | 5/713 |
| 6,151,740 | A * | 11/2000 | Morimoto et al. | 5/710 |
| 6,240,584 | B1 * | 6/2001 | Perez et al. | 5/713 |
| 6,282,735 | B1 * | 9/2001 | Stolpmann et al. | 5/606 |
| 6,418,579 | B2 * | 7/2002 | Perez et al. | 5/713 |
| 6,568,013 | B2 * | 5/2003 | Perez et al. | 5/710 |
| 6,618,884 | B1 | 9/2003 | Wu | |
| 6,651,283 | B1 * | 11/2003 | Cook et al. | 5/713 |
| 6,823,549 | B1 * | 11/2004 | Hampton et al. | 5/713 |
| 7,028,358 | B2 * | 4/2006 | Liu | 5/710 |
| 2002/0133883 | A1 | 9/2002 | Perez | |
| 2003/0019041 | A1 | 1/2003 | Inchaustegui | |
| 2004/0255386 | A1 | 12/2004 | Liu | |
| 2008/0271253 | A1 * | 11/2008 | Pile | 5/710 |

FOREIGN PATENT DOCUMENTS

| | | |
|---|---|---|
| EP | 1 151 698 A | 11/2001 |
| GB | 2 267 217 A | 12/1993 |

* cited by examiner

PRIOR ART

ALTERNATING PRESSURE MATTRESSES

FIELD OF THE INVENTION

This invention relates to inflatable supports for patients, particularly human patients, for example mattresses for beds. The invention also relates to a method of operation of such supports.

BACKGROUND OF THE INVENTION

For patients suffering from bedsores (decubitus), risk of bedsores or burns, mattresses which provide pressure relief have long been known and many have been placed on the market and put in use. A first type of such mattresses is exemplified by the Pegasus Airwave (registered trade mark) mattress, which has a double-layer array of cells in the form of tubes which are divided into groups which are sequentially inflated and deflated in a predetermined cycle (see GB-A-1595417). The tubes are of air-impermeable material, and are deflated by venting to atmosphere. Alternatively, in accordance with GB-A-2312835, the tubes are deflated by connection to a suction pump or pumps. It is an advantage of the Pegasus Renaissance mattress that it permits the use of an overlay or cover between the array of tubes and the patient, which has merits in hygiene and infection control, as well as appearance and comfort. A particular form of cover, which minimizes risk of interface pressure retention, is described in patent application EP-A-827705 of Pegasus.

It is preferable for the mattress to have means for preventing a patient from rolling off the mattress. Ideally the means is provided by portions of the mattress itself, e.g. by formations provided along both sides of the mattress.

Previously, this has been achieved using inflatable cells, known as side formers, located at sides of the mattress, which remain inflated continuously during inflation and deflation cycles of the groups of tubes. However, these side formers need an air supply which is independent of the alternating pressure air supply to the tubes. This causes manufacturing difficulties, and increases costs.

Alternative prior art side formations are e.g. solid side formations, formed of e.g. foam material. However, during Cardiopulmonary Resuscitation (CPR) procedures etc., where unobstructed access to a patient lying on the mattress is required, it is desirable for the mattress to be made flat. Unlike inflatable side formations, which can be deflated, solid side formations remain protruded from the mattress always.

SUMMARY OF THE INVENTION

At its most general, the present invention provides an alternating pressure mattress comprising a plurality of inflatable side formations, located on both sides of the mattress, which can be inflated and deflated cyclically in a predetermined sequence.

According to the present invention, there is provided an alternating pressure mattress including:

a first set of cells, comprising a plurality of inflatable first central cells and plurality of inflatable first side forming cells;

a second set of cells, comprising a plurality of inflatable second central cells and plurality of inflatable second side forming cells;

the first and second sets of cells being selectably connectable to a gas supply such that the first set of cells and the second set of cells are inflatable and deflatable cyclically in a predetermined sequence;

wherein:

the first and second central cells are provided along a central region between the head end and foot end of the mattress;

a plurality of the first and second side forming cells are provided along a first side region of the mattress; and a plurality of the first and second side forming cells are provided along a second side region of the mattress.

The mattress is not limited to having two sets of cells. Further sets of cells, similar or identical to the first and second sets of cells, can be provided, with the inventive effect still being achievable.

The mattress of the present invention is preferably used as a 'topper' for an existing mattress, i.e., in use, it preferably rests on the top of an existing mattress. Nevertheless, it is envisaged that the mattress of the present invention could be designed, amongst other things, as a self-supporting 'replacement' mattress, that does not need to rest on an existing mattress.

In the case of a mattress for a patient to lie on, the longitudinal direction of the mattress is defined herein as the direction running between the head end and the foot end of the mattress, with the lateral direction of the mattress being construed accordingly.

Preferably, the first and second central cells are elongated in the lateral direction of the mattress, and preferably the first and second side forming cells are elongated in the longitudinal direction of the mattress.

Preferably, the first and second side forming cells each have a dimension in the longitudinal direction of the mattress greater than that of each of the first and second central cells.

Preferably the first and second side forming cells and central cells, when inflated and viewed in plan view, each have a generally rectangular shape.

Alternatively, the side forming cells, when inflated and viewed in plan view, may each have a generally circular shape. However, by providing side forming cells with the rectangular shape, the side forming cells can cover a larger mattress area.

Preferably, when inflated, the side forming cells protrude further from the mattress than the central cells. Therefore, the side forming cells may prevent a user of the mattress from rolling off the mattress.

The first and second sets of cells may include a number of groups (or 'modules') of interconnected central and side forming cells. Each of these cell groups may be supplied with inflation gas, via a single cell opening, e.g. a t-joint, provided in one of the cells of the group.

Preferably, the first set of cells includes a plurality of first cell groups, each first cell group comprising a said first side forming cell located along the first side region and having a respective opening to two of the first central cells, only one of the two first central cells having an opening to a said first side forming cell located along said second side region; and preferably, said second set of cells includes a plurality of second cell groups, each second cell group comprising a said second side forming cell located along the second side region and having a respective opening to two of the second central cells, only one of the two second central cells having an opening to a said second side forming cell located along the first side region.

Preferably, the first and second cell groups are each supplied by a separate gas supply tube, e.g. via a tee joint welded to each of the first and second cell groups and a valve located upstream of said tee joint. The tee joint may provide the mattress with increased structure, most notably when the mattress is completely deflated. This allows easy placement of a cover on top of the mattress. The cover may provide a comfortable layer for a patient to lie on. Nevertheless, it is preferable the mattress of the present invention can be rolled up, when deflated, for ease of transportation.

Alternatively, the first cell groups may be supplied with gas via a first side chamber provided along the first side region of the mattress, and the second cell groups may be supplied with gas via a second side chamber provided along the second side region of the mattress. Accordingly, only one tube is needed to supply inflation gas to each set of cells.

Preferably, the first side forming cells located along the first side region each have an opening to the first side chamber; and said second side forming cells located along the second side region each have an opening to the second side chamber.

Preferably, first and second central cells are provided alternately, in the longitudinal direction of the mattress, along the central region of the mattress.

Preferably, first and second side forming cells are provided alternately, in the longitudinal direction of the mattress, along both the first and second side regions of the mattress.

Preferably the mattress is provided with inflation means, for inflating the first and second sets of cells, and a dump means, for dumping gas from the first and second sets of cells, e.g. to atmosphere. Preferably the mattress further includes a control means for causing the cells to be connected to the inflation means, and to the dump means, cyclically in a predetermined cyclical sequence.

Inflation means, dump means and control means, for alternating pressure mattresses, are well known in the art. The skilled person will understand that rotor valve systems, solenoid systems, or stepper motors etc. can be used for these purposes. A rotor valve system comprises a rotor and a stator. Inflation means may comprise a single pump or multiple pumps.

Preferably a rotor valve system is used in the mattress of the present invention. Preferably, cyclical inflation and deflation of the first and second sets of cells is provided when the rotor rotates in either direction. However, it is recognised that timing of the cyclical inflation and deflation may be optimised when the rotor is arranged to rotate in one direction.

In prior art alternating pressure systems it is known to dump gas from a set of deflating cells to a set of inflating cells, e.g. via a valve. FIG. 5 shows a graph of the variation in gas pressure for a first set of cells (series 1) and a second sets of cells (series 2), over a period of time, for such a prior art system.

In the present invention, preferably no dumping of gas occurs between the first set of cells and the second set of cells. Instead, gas is preferably dumped from the cells to atmosphere. This is preferable as it may avoid a 'cross-over period' where neither the first set of cells, or the second set of cells, are adequately inflated for supporting the user of the mattress. 'Cross-over periods' are common with systems that dump gas between sets of cells. A 'cross-over period' is indicated by reference letter 'X' in FIG. 5.

In the present invention, preferably the control system is such that the first set of cells is inflated before the deflation of the second set of cells begins, and vice-versa.

In addition to the above combinations of features, the mattress may further include, at the head end, a third set of cells comprising a plurality of adjacent cell groups which are connectable to a gas supply in a mode in which they are inflatable in unison with each other, while said first and second sets of cells are inflated and deflated cyclically in said predetermined sequence.

INTRODUCTION OF THE DRAWINGS

Further explanation of the invention and embodiments of it will now be described, by way of non-limitative example, with reference to the accompanying drawings, in which.

DESCRIPTION OF EMBODIMENTS OF THE INVENTION

Figure 1:
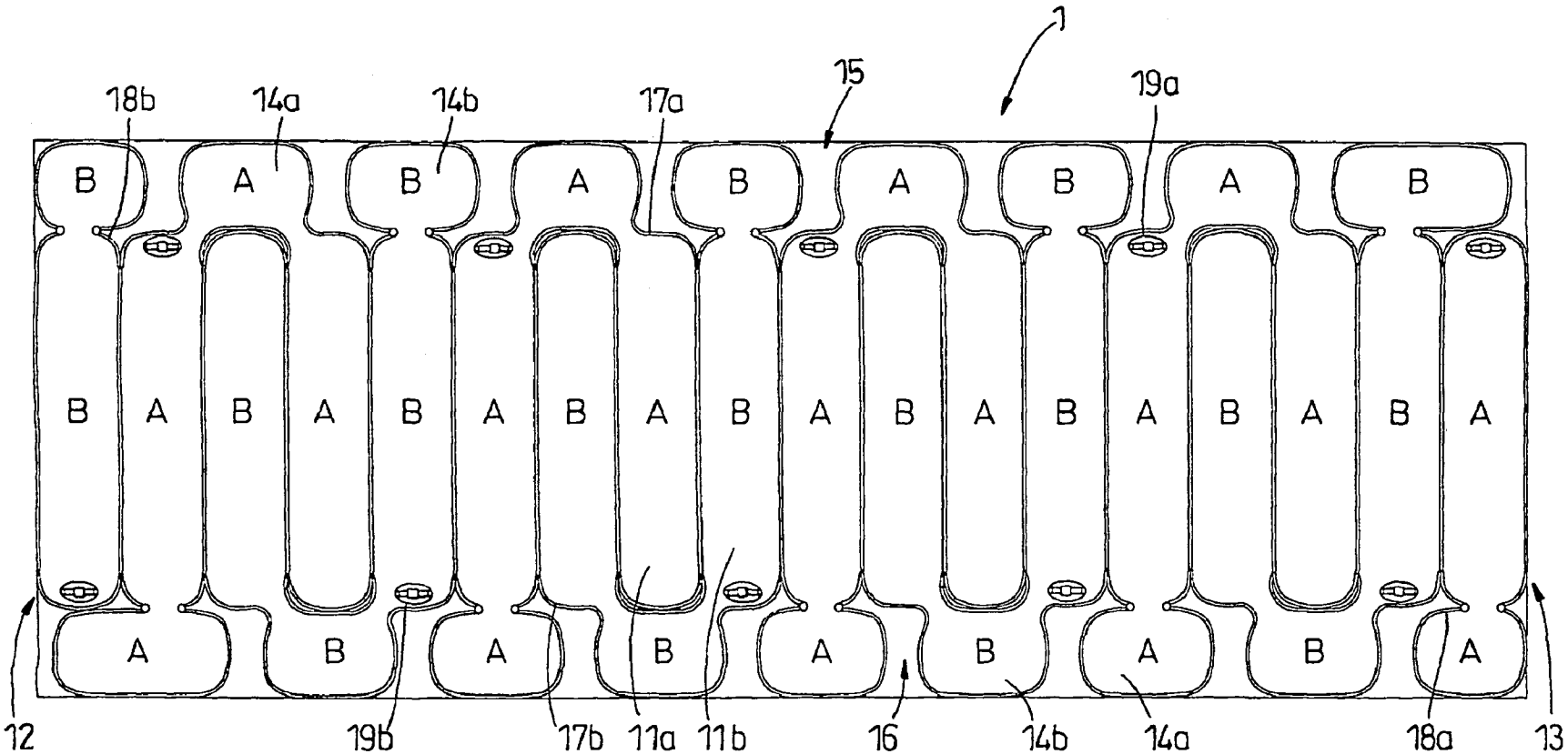
FIG. 1 is a plan view of a deflated mattress according to a first embodiment of the invention.
Figure 2:
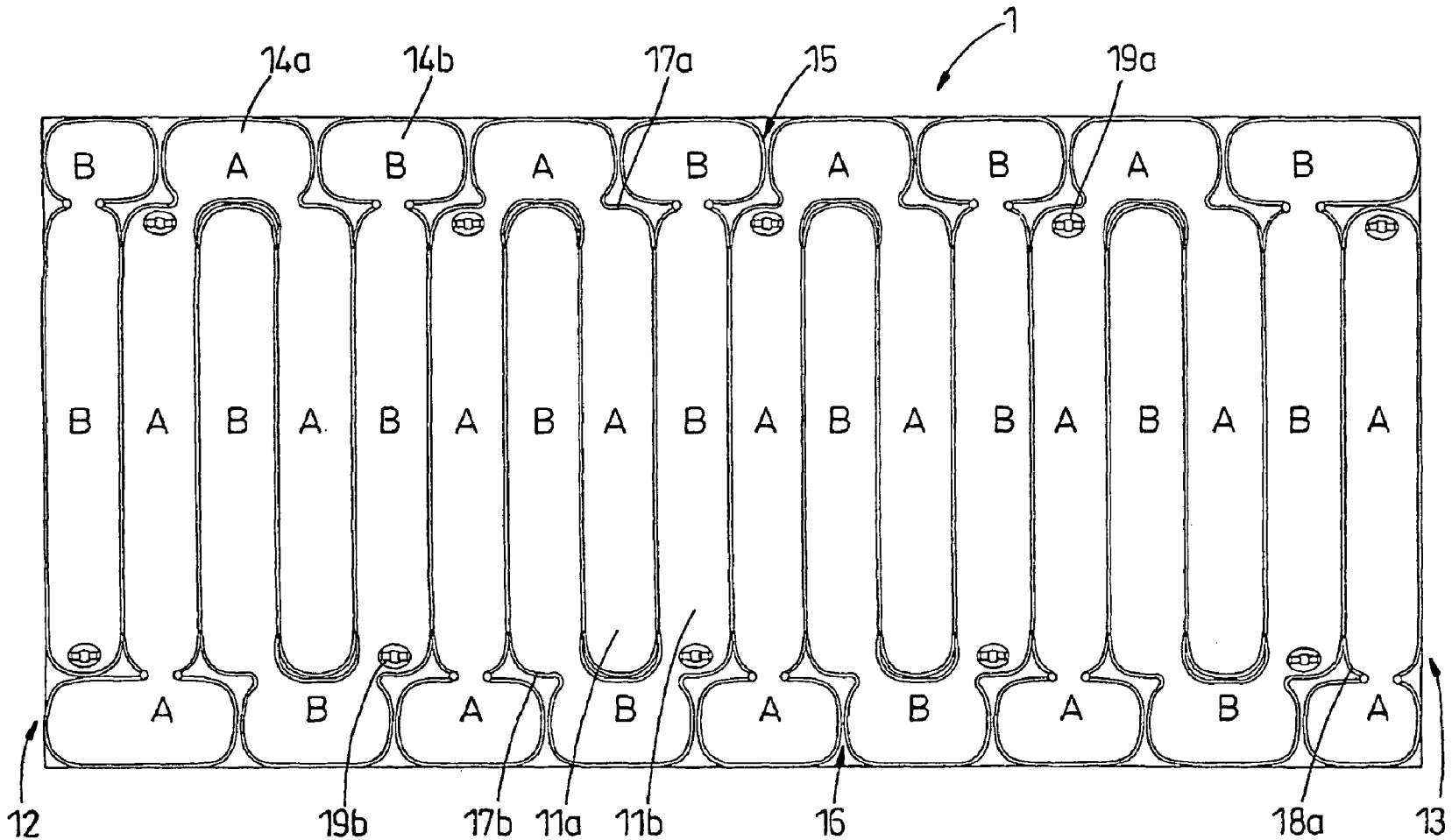
FIG. 2 is a plan view of the mattress of FIG. 1 inflated.

A first embodiment of a mattress according to the present invention will now be described with reference to FIGS. 1 and 2. FIG. 1 shows the mattress 1 deflated, and FIG. 2 shows the mattress fully inflated.

The mattress 1 is formed of two layers of air impermeable thermoplastic polymer material, and comprises a plurality of inflatable cells distributed across the mattress 1 in a desired pattern. The cells are formed by heat sealing selected overlying adjacent portions of each layer together. The heat-sealed portions define the peripheral extents of respective cells, and gaps between heat sealed portions allow communication between cells. Double-lines in FIGS. 1 and 2 represent heat sealing lines, and show how cells are separated from one another.

The mattress 1 comprises two sets of cells. In FIGS. 1 and 2, cells belonging to a first set of cells are indicated by reference letter 'A', and cells belonging to a second set of cells are indicated by reference letter 'B'. The cells of the first set (A) are configured to inflate and deflate in unison, and, likewise, the cells of the second set (B) are configured to inflate and deflate in unison.

The first set (A) of cells includes a plurality of first central cells 11*a*, and the second set (B) of cells includes a plurality of second central cells 11*b*. The first and second central cells 11*a*, 11*b* are provided alternately along a central region of the mattress, running between the head end 12 and the foot end 13 of the mattress. The first and second central cells 11*a*, 11*b* are generally cylindrical in shape when inflated, elongated in the lateral direction of the mattress. In use, inflated first or second central cells 11*a*, 11*b* support a user lying on the mattress.

Furthermore, the first set (A) of cells includes a plurality of first side forming cells 14*a*, and the second set (B) of cells includes a plurality of second side forming cells 14*b*. The first and second side forming cells 14*a*, 14*b* are provided both sides of the central region, along a first side region 15 and a second side region 16. Like the central region, the first and second side regions 15, 16 extend from the head end 12 to the foot end 13 of the mattress.

Inflated first and second side forming cells 14*a*, 14*b* are designed to protrude from the mattress 1 to a greater height than inflated central cells 11*a*, 11*b*. This is achieved by providing the side forming cells 14*a*, 14*b* with a dimension in the longitudinal direction of the mattress greater than the central cells 11*a*, 11*b*.

By protruding in this manner, the side forming cells 14*a*, 14*b* act as side barriers. They can prevent a user, lying on inflated central cells 11*a*, 11*b*, from rolling off the mattress 1.

In FIGS. 1 and 2, it can be seen that each side region 15, 16 is provided with first and second side forming cells 14*a*, 14*b* alternating along the longitudinal direction of the mattress. This means that, when the e.g. first set (A) of cells is inflated and the second set (B) of cells is deflated, the side formers of the first set (A) of cells, which are distributed evenly along both side regions 15, 16 of the mattress 1, thus provide, in combination, effective side barriers.

The first set (A) of cells includes a plurality of first cell groups 17*a*, 18*a*, and the second set (B) of cells includes a plurality of second cell groups 17*b*, 18*b*. Each cell group 17*a*, 17*b*, 18*a*, 18*b* comprises interconnected central cells 11*a*, 11*b* and side forming cells 14*a*, 14*b*.

In FIGS. 1 and 2, two types of cell groups 17*a*, 17*b*, 18*a*, 18*b* are shown, for each set (A, B) of cells. One type of cell group 17*a*, 17*b* has a generally u-shaped configuration of cells. The u-shaped configuration comprises two central cells 11*a*, 11*b* having openings to a same side forming cell 14*a*, 14*b* located at a side region 15, 16 of the mattress. Also, one of the two central cells 11*a*, 11*b* has an opening to a side forming cell 14*a*, 14*b* located at the opposite side region 15, 16 of the mattress 1.

As FIGS. 1 and 2 show, u-shaped cell groups 17*a* of the first set (A) of cells are interdigitated with inverted u-shaped cell groups 17*b* of the second set (B) of cells.

A second type of cell group 18*a*, 18*b* has a generally i-shaped configuration of cells. The i-shaped configuration comprises just one central cell 11*a*, 11*b* having an opening to a side forming cell 14*a*, 14*b* located at one side region 15, 16 of the mattress 1.

As FIGS. 1 and 2 show, an i-shaped group 18*a* of the first set (A) of cells is located at the foot end 13 of the mattress, and an inverted i-shaped group 18*b* of the second set (B) of cells is located at the head end 12 of the mattress 1. It can be seen that a side forming cell 14*a*, 14*b* of the unshaped group 17*a*, 17*b* adjacent each i-shaped group 18*a*, 18*b* is elongated in the longitudinal direction of the mattress 1 to a greater degree than the other side forming cells 14*a*, 14*b*. This side forming cell 14*a*, 14*b* essentially fills a gap at a corner of the mattress 1 next to each i-shaped group 18*a*, 18*b*.

Each cell group 17*a*, 17*b*, 18*a*, 18*b* is connected to a gas supply (not shown) via tubing (not shown). The tubing is connected to respective valves (not shown) in series with tee-joints 19*a*, 19*b*, welded to each cell group 17*a*, 17*b*, 18*a*, 18*b*. The tee-joints 19*a*, 19*b* are provided at one end of a central cell 11*a*, 11*b* of each cell group 17*a*, 17*b*, 18*a*, 18*b*.

Although not shown, the mattress is provided with an inflation means, for inflating the first and second sets of cells (A, B) and a dump or deflation means, for dumping gas in the first and second sets of cells (A, B) to atmosphere. The mattress further includes a control means (not shown) for connecting the first and second sets of cells (A, B) to the inflation means and to the dump means cyclically in a predetermined cyclical sequence.

In the present embodiment, the inflation means, deflation means and control means are provided by a rotor valve system, which comprises a rotor and a stator.

Figure 3:
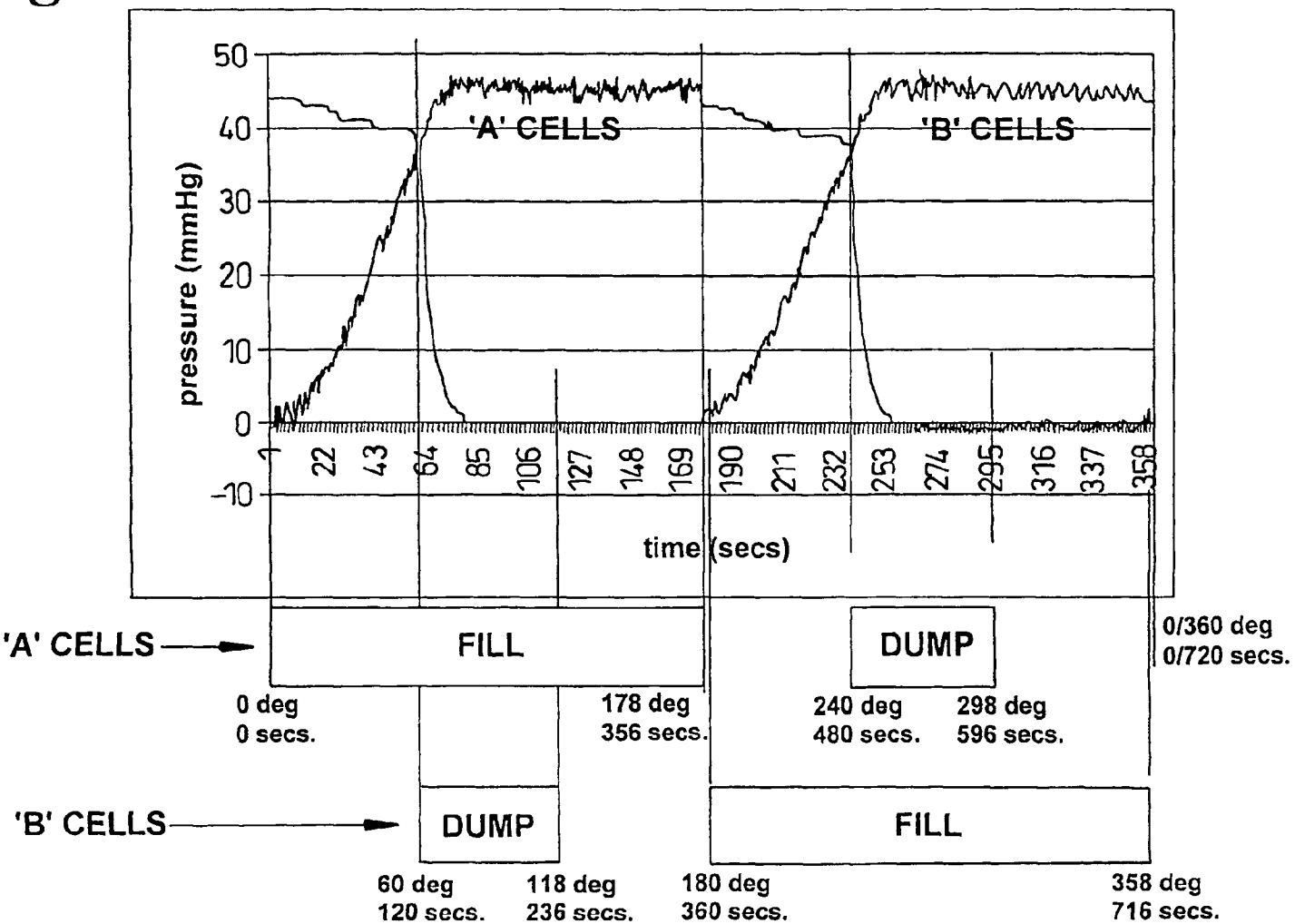
FIGS. 3 and 4 are graphs showing gas pressures in first and second sets of cells over time, without a cross-over period.
Figure 4:
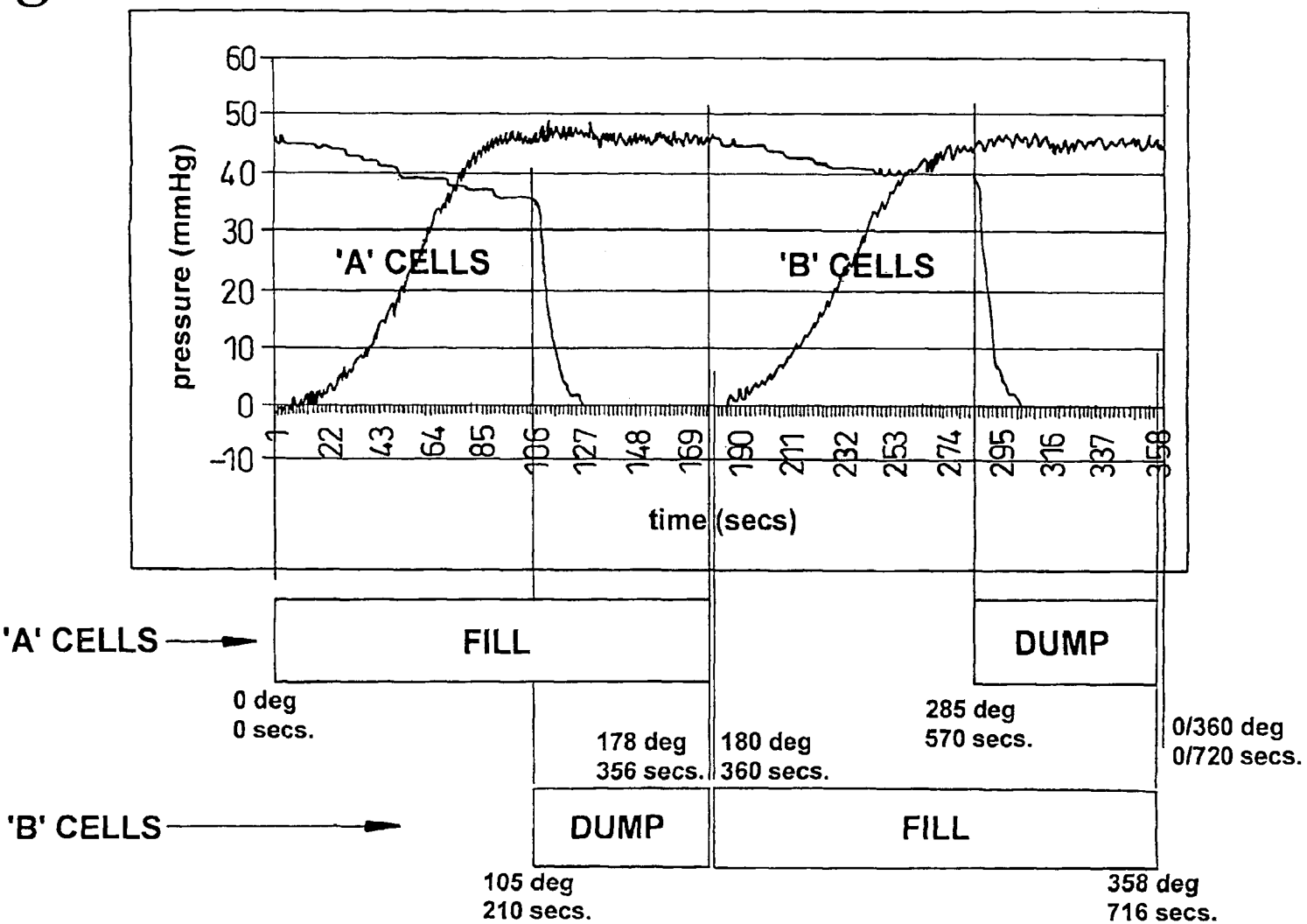
Figure 5:
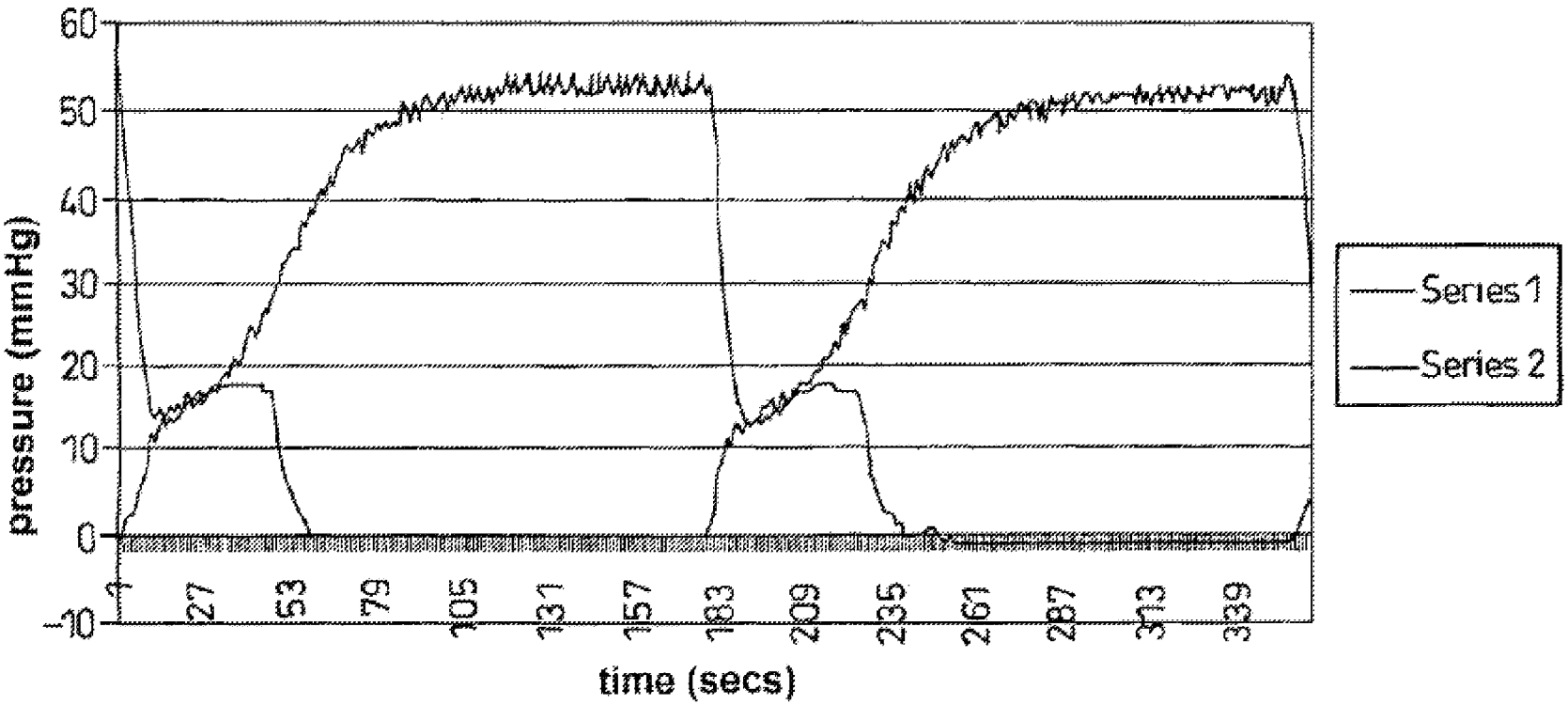
FIG. 5 is a graph showing pressures of first and second sets of cells over time, with a cross-over period.

FIGS. 3 and 4 show graphs of the variation in gas pressure in the first and second sets of cells over a period of time. Gas pressure increases in the cells as they are inflated, and decreases as they are deflated. The graphs show inflation and deflation cyclic periods for each of the first and second sets of cells (A, B) of approximately 12 minutes. The maximum gas pressure shown in the graphs is approximately 45 mmHg. Of course, systems having different cyclic periods and maximum pressures could be used as appropriate to e.g. a user of the mattress.

As the rotor disc of the rotor valve system rotates, it sequentially causes inflation, or 'filling', and deflation, or 'dumping', of the first or second set of cells (A,B). As FIGS. 3 and 4 show, gas in one of the sets of cells (A, B) is dumped only after the other of the sets of cells (A, B) is almost fully inflated. This is desirable since, in normal use, a patient should be supported on a plurality of sufficiently inflated central cells at all times, and prevented from rolling off the mattress by a plurality of sufficiently inflated side forming cells at all times.

The rotor valve systems used in the mattresses of FIGS. 3 and 4 are different. With the mattress of FIG. 3, dumping of gas in one set (A, B) of cells occurs during a period of time midway through the period of time in which the other set (A, B) of cells is filled. Accordingly, this configuration of inflation and deflation periods is described herein as 'symmetrical'. The symmetry allows the rotor disc to be rotated in either direction, without significant change to the inflation and deflation cycles.

With the mattress of FIG. 4, dumping of gas in one set (A, B) of cells occurs over a period of time toward the end of the period of time that the other set (A, B) of cells is filled. Accordingly, this configuration of inflation and deflation periods is described herein as 'asymmetrical'. The asymmetry means that the rotor disc can only be rotated in one direction, for the system to work in the desired manner.

A symmetrical system is cheaper to manufacture, and easier to use than an asymmetrical system. Nevertheless, an asymmetrical system can be configured to provide the most optimal timings for inflation and deflation of the first and second sets (A, B) of cells.

Figure 6:
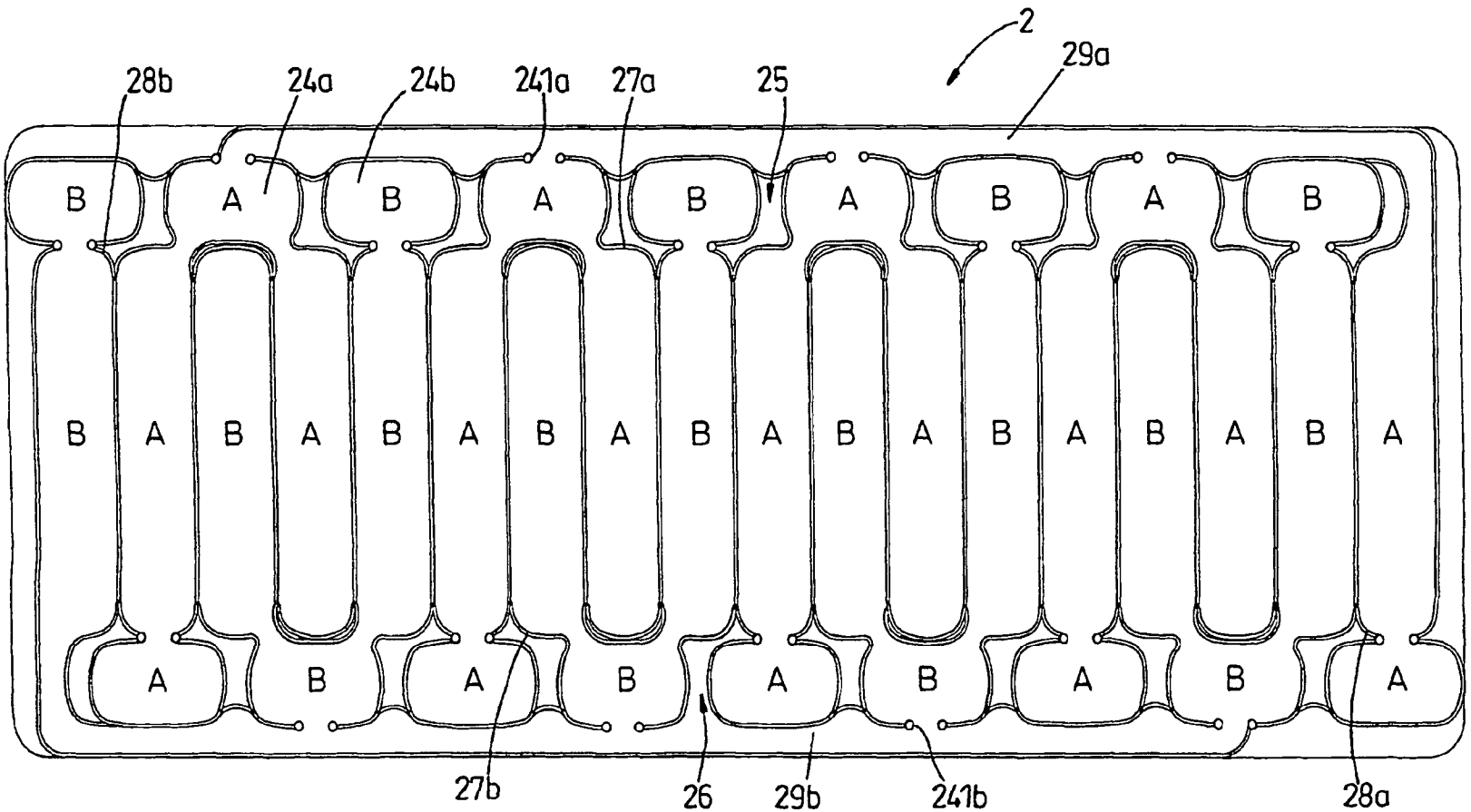
FIG. 6 is a plan view of a mattress according to a second embodiment of the invention.

A second embodiment of the invention will now be described with reference to FIG. 6. FIG. 6 shows a mattress 2 comprising first and second sets (A, B) of cells, formed and arranged in a similar manner to first and second sets (A, B) of cells of the mattress 1 of the first embodiment of the invention. However, in the second embodiment, cell groups 27*a*, 27*b*, 28*a*, 28*b*, configured similarly to the cell groups 17*a*, 17*b*, 18*a*, 18*b* in the first embodiment, do not have t-joints 19 for connection to a gas supply via tubing.

Instead, the cell groups 27*a*, 28*a* of the first set (A) of cells each have an opening 241*a* between a side forming cell 24*a*, 24*b* and a first side connection chamber 29*a* provided along the first side region 25 of the mattress, and the cell groups 27*b*, 28*b* of the second set (B) of cells each have an opening 241*b* to a second side connection chamber 29*b* provided along the second side region 26 of the mattress 2.

Accordingly, each set (A, B) of cells need only be supplied with gas via tubing (not shown) connected to the side connection chambers 29*a*, 29*b*, rather than to each cell group 27*a*, 27*b*, 28*a*, 28*b*. However, the side connection chambers 29*a*, 29*b* add increased bulk to the mattress 2, making the mattress 2 more cumbersome than the mattress 1 of the first embodiment of the invention.

Figure 7:
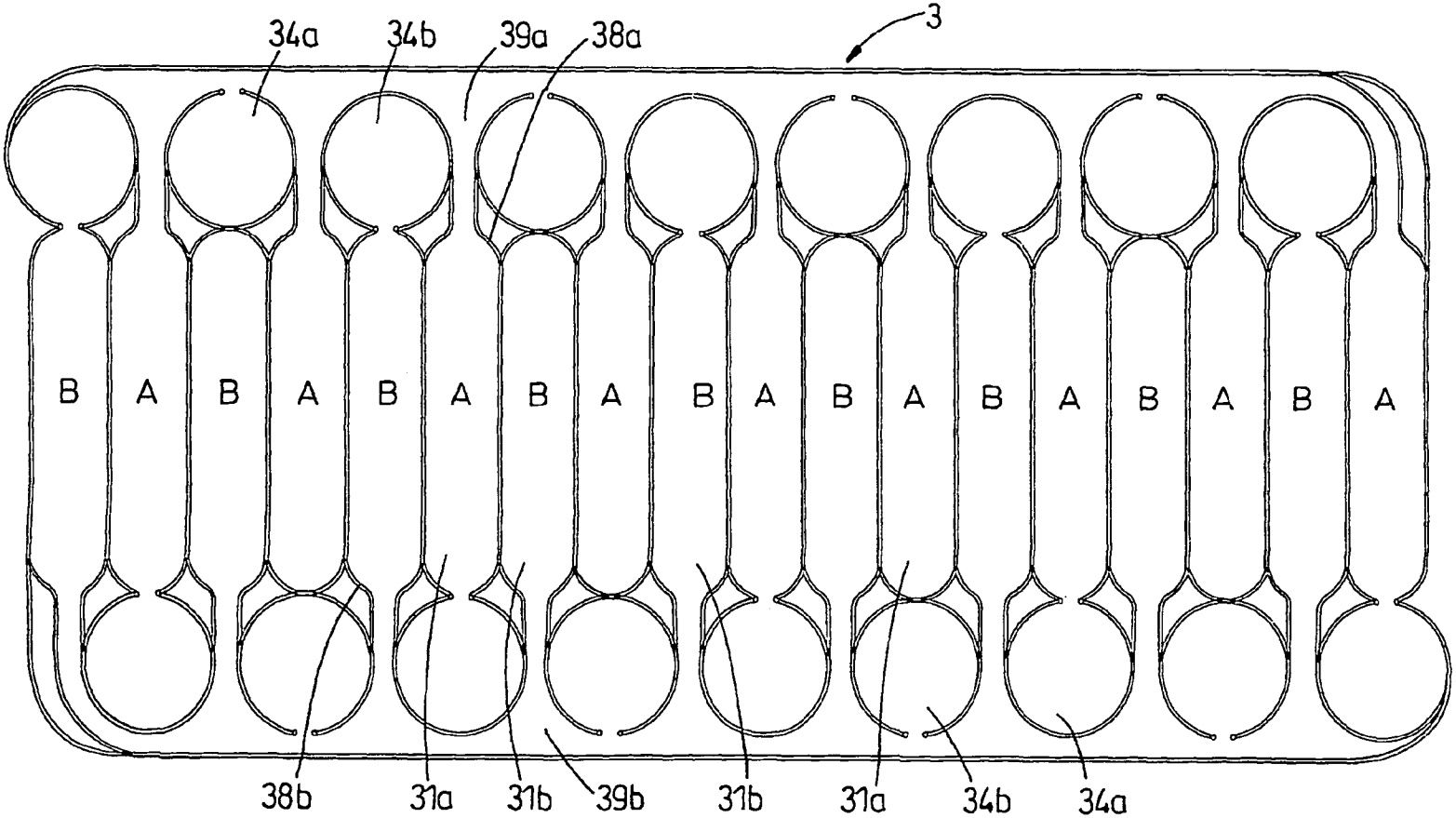
FIG. 7 is a plan view of a mattress according to a third embodiment of the invention.

A third embodiment of the invention will now be described with reference to FIG. 7. Like the mattress 2 of the second embodiment of the invention, FIG. 7 shows a mattress 3 with two sets (A, B) of cells having cells with openings to first and second side chambers 39*a*, 39*b*. However, cell groups are configured differently. The mattress is formed by heat sealing of two superposed layers, in the same way as described above.

Each set (A, B) of cells comprises a plurality of cell groups 38*a*, 38*b*, formed and configured similarly to the i-shaped cell groups 18*a*, 18*b*, 28*a*, 28*b* shown in FIGS. 1, 2 and 7. The cell groups 38*a* of the set (A) have two types 31*a*, 34*a* of cell group. The cell groups 38*b* of set (B) have two types 31*b*, 34*b* of cell group. Each first central cell 31*a* of the first set (A) of cells, has an opening to a first side chamber 39*a*. The second central cell 31*b*, of each i-shaped group of the second set (B) of cells, has an opening to a second side chamber 39*b*.

Interposed between i-shaped groups 38*a*, 38*b* of first and second sets of cells (A, B) are individual first side forming cells 34*a* and first central cells 31*a*, each with openings to a first side connection chamber 39*a*, and individual second side forming cells 34*b* and second central cells 31*b* each with openings to the second side connection chamber 39*b*.

The first and second side forming cells 34*a*, 34*b* are generally circular when viewed in plan view.

A fourth embodiment of the invention will now be described with reference to FIG. 8. As in FIGS. 1, 2, 6 and 7, double lines indicate heat seal lines defining the cells.

Figure 8:
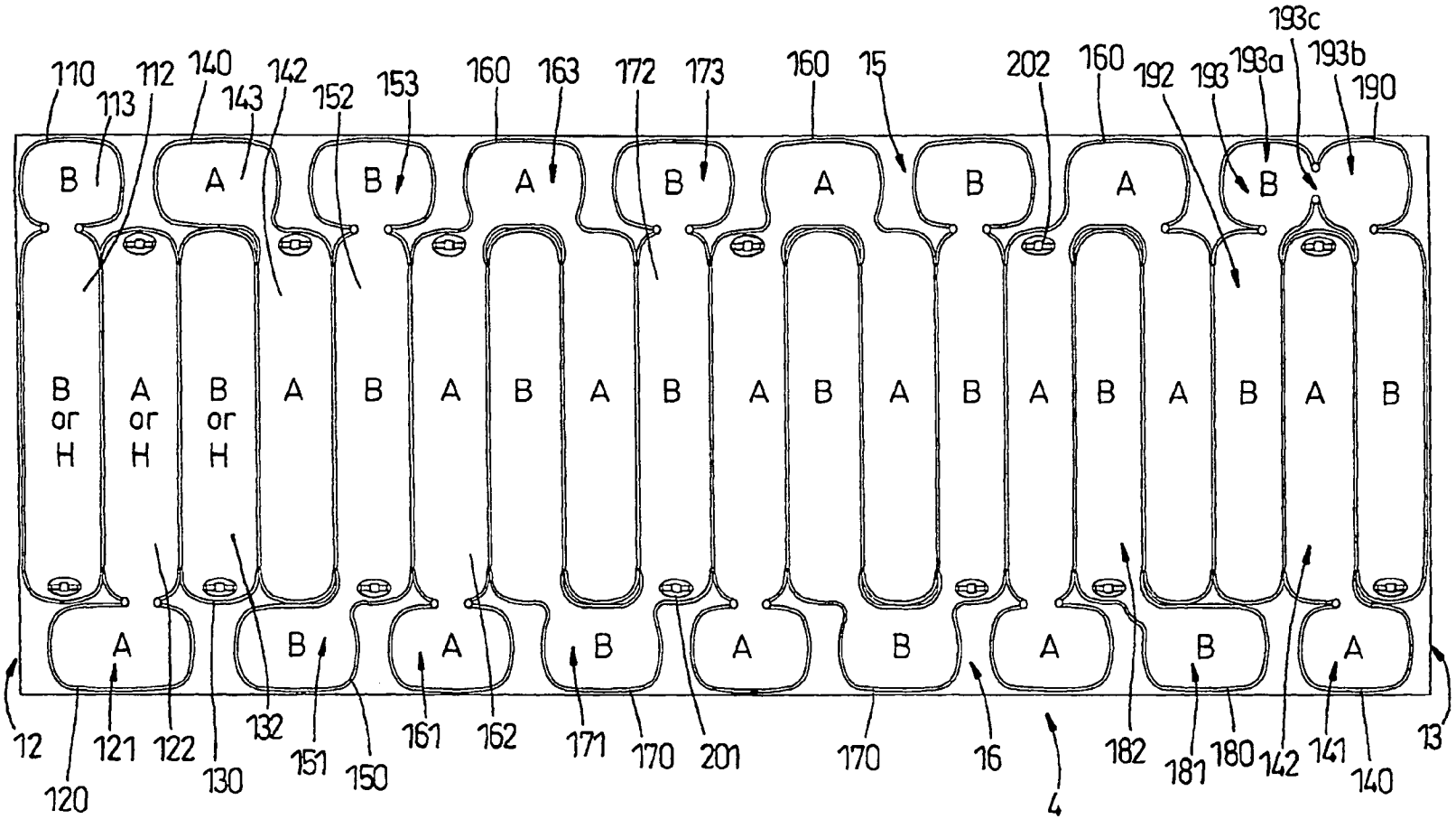
FIG. 8 is a plan view of a mattress according to a fourth embodiment of the invention.

FIG. 8 shows a mattress 4 with first and second sets (A, B) of cells arranged in a similar manner to the sets (A, B) of cells of mattress 1 shown in FIG. 1. These sets of cells may be inflated and deflated cyclically in a predetermined cyclical sequence, as in the first embodiment of the invention. However, in this embodiment, the cell groups are configured differently to those in the first embodiment.

There are, as in FIG. 1, a number of cell groups between the head end 12 and the foot end 13 of the mattress 4, which each belong to set of cells (A), or set of cells (B). However, among these cell groups three cell groups 110, 120, 130 at the head end 12 have an additional function, as described below.

Three cell groups 160 of set (A) and two cell groups 170 of set (B) are arranged in a similar way to the u-shaped groups of cells 17*a*, 17*b* shown in FIG. 1, each comprising two elongate transverse central cells 162, 172, opening to a same side forming cell 163, 171 located at a side region 15, 16 of the mattress 4. Also, one of the two central cells opens to a side forming cell 161, 173 located at the opposite side region 15, 16 of the mattress 4.

A further cell group 190 of set (B) comprises two central cells 192 opening to a side forming cell 193 located at the side region 15 of the mattress 4. This side forming cell 193 is split into two chambers 193*a*, 193*b*, joined together by a narrow passage 193*c*. This is necessary to maintain the correct length of the side forming cell 193 when inflated. If this division was not made, the central cells 142, 192 would not assume their correct centre-to-centre spacing when inflated because of the effective length of the side forming cell 193. By splitting the side forming cell 193 into two chambers 193*a*, 193*b*, the length of the side forming cell 193 decreases sufficiently when inflated to allow the transverse central cells 142, 192 to assume their correct position when inflated.

The second set (B) of cells also includes a cell group 180 comprising a single central cell 182 opening to one side forming cell 181 located at the side region 15 of the mattress 4. This side forming cell 181 is not located directly adjacent to the central cell 182 in the lateral direction, but is positioned further along the mattress 4 in its longitudinal direction. The first set (A) also includes two such cell groups 140 in which the side forming cell 141, 143 is not located directly adjacent to the central cell 142 in the lateral direction.

The second set (B) of cells includes a cell group 150 comprising a single central cell 152 opening to two side forming cells 151, 153 located at respective side regions 15, 16 of the mattress 4. Again, one of the side forming cells 151 is not located directly adjacent to the central cell 152 in the lateral direction, but is positioned further along the mattress 4 in its longitudinal direction.

As with the first embodiment, the arrangement of the cells is such that along each side region 15, 16 of the mattress, the side forming cells are members of alternately set (A) and set (B). These side forming cells are elongated in the longitudinal direction of the mattress and when inflated protrude upwardly further than the central cells. Therefore, when a patient is lying on the central cells of the mattress 4 and the cell groups are made to inflate and deflate cyclically, a sufficient barrier is present at all times along each side 15, 16 of the mattress 4, to hinder the patient from rolling off the mattress 4.

As mentioned above, at the head end 12, the mattress 4 includes three adjacent cell groups 110, 120, 130 which are members of sets (A, B) but are in an alternative operating mode to be regarded as belonging to a third set (H) of cells as indicated by the reference letter 'H' in FIG. 8. Two cell groups 110, 120 comprise central cells 112, 122 opening respectively to single side forming cells 113, 121 located at opposite side regions 15, 16 of the mattress 4. The remaining cell group 130 of the third set (H) of cells comprises just a single central cell 132.

As in the first embodiment of the invention, the cell groups of mattress 4 may be supplied with inflation gas, typically air, via conduits including tee joints 201, 202 welded to one cell of each of the cell groups. Each cell group of the third set (H) of cells is connectable to a gas supply such that it is inflatable in unison with the other cell groups in the set (H).

Although not shown, the mattress 4 is provided with an inflation means, for inflating the first, second and third sets (A, B, H) of cells. Such inflation means may be for example one or more compressor pumps. The cells are also connectable to deflation or dump means (venting to atmosphere).

The mattress further includes control means (not shown) for connecting the first, second and third sets (A, B, H) of cells to the inflation means and for causing their deflation, in a number of modes of operation. Such control means typically includes a rotor valve, as is well known for such alternating pressure mattresses. Additionally, there must be valve arrangements to permit switching of the device between the different operational modes. In this embodiment there are four such modes of operation.

In a first mode, the control means connects the first and second sets (A, B) of cells, other than the cells of the third set (H), to the inflation means and to the dump means cyclically in a predetermined cyclical sequence as in the embodiment of FIG. 1, while the third set (H) of cells is connected to the inflation means such that the inflation of all of the cell groups 110, 120, 130 of the third set (H) of cells is maintained continuously. With this, the inflated cell groups 110, 120, 130, support a patient's head while the remainder of the cells of the mattress 4 inflate and deflate cyclically. This is comfortable for the patient.

In a second mode, the control means connects the first and second sets (A, B) of cells, including the cells of the third set (H), to the inflation means and to the dump means cyclically in a predetermined cyclical sequence such that all of the cell groups of the mattress 4 inflate and deflate cyclically, as in the embodiment of FIG. 1.

In a third mode, the control means connects the third set (H) of cells to the inflation means such that the inflation of each of the cell groups 110, 120, 130 of the third set (H) of cells is maintained, while the remainder of the first and second sets of cells (A, B) are connected to the dump means, such that all the cell groups of the first and second sets of cells (A, B) are deflated.

In the event that it is necessary to perform Cardiopulmonary Resuscitation (CPR) on a patient lying on the mattress 4, a fourth mode of operation is used, in which all the cell groups of the mattress 4 are deflated. Typically, known systems for inflating air filled mattresses inflate cells at the head end of a mattress via a non-return valve, and deflate the head cells by a separate valve, such as a twist-action valve, or by pulling a tab connected to stopper valves in air supply lines to cells at the head end of a mattress. Both of these known methods require a valve to be reset or closed prior to further use.

In the present invention, the third set (H) of cells is inflated with air supplied from at least one of the first and second sets (A, B) of cells via a non-return valve. This maintains the inflated state of the cell groups 110, 120, 130 during normal operation. An additional pipe is provided between the cell groups 110, 120, 130 and a mattress air connector, which is blocked at the air connector end to maintain the air pressure in the third set (H) of cells. When the air in the whole mattress needs to be removed to perform CPR on a patient, only the air connector needs to be disconnected for all the cells of the mattress 4 to deflate simultaneously by venting to atmosphere. The third set (H) of cells then vent through the additional pipe.

When it is later desired to re-inflate the mattress, following deflation of all of the cells, only the air connector needs to be reconnected. No other valves need to be reset, as in existing inflatable mattress designs.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An alternating pressure mattress, including:

a first set of cells, comprising a plurality of inflatable first central cells and a plurality of inflatable first side forming cells;

a second set of cells, comprising a plurality of inflatable second central cells and a plurality of inflatable second side forming cells;

said first and second sets of cells being selectably connectable to a gas supply such that said first set of cells and said second set of cells are inflatable and deflatable cyclically in a predetermined sequence;

wherein:

said first and second central cells are provided along a central region between a head end and a foot end of the mattress;

a plurality of said first and second side forming cells are provided along a first side region of the mattress;

a plurality of said first and second side forming cells are provided along a second side region of the mattress;

said first set of cells includes a plurality of first cell groups wherein each said first cell group comprises a said first side forming cell located along said first side region and having a respective opening to two of said first central cells, only one of said two first central cells having an opening to a said first side forming cell located along said second side region; and said second set of cells includes a plurality of second cell groups wherein each said second cell group comprises a said second side forming cell located along said second side region and having a respective opening to two of said second central cells, only one of said two second central cells having an opening to a said second side forming cell located along said first side region.

2. An alternating pressure mattress according to claim 1, wherein said first and second central cells are elongated laterally relative to the mattress.

3. An alternating pressure mattress according to claim 1, wherein said first and second side forming cells are elongated longitudinally relative to the mattress.

4. An alternating pressure mattress according to claim 1, wherein said first and second side forming cells have a longitudinal dimension greater than the longitudinal dimension of the first and second central cells.

5. An alternating pressure mattress according to claim 1, wherein each of said first and second cell groups is supplied by a separate gas supply tube.

6. An alternating pressure mattress according to claim 5, wherein said separate gas supply tubes supply gas via a tee joint welded to each of said first and second cell groups.

7. An alternating pressure mattress according to claim 1 wherein:

said first set of cells is in fluid communication with a first side connection chamber provided along said first side region; and said second set of cells is in fluid communication with a second side connection chamber provided along said second side region.

8. An alternating pressure mattress according to claim 7, wherein:

said first side forming cells located along said first side region each have an opening to said first side connection chamber; and said second side forming cells located along said second side region each have an opening to said second side connection chamber.

9. An alternating pressure mattress according to claim 1, wherein:

when inflated, said first side forming cells protrude further from the mattress than said first central cells, and when inflated, said second side forming cells protrude further from the mattress than said second central cells.

10. An alternating pressure mattress according to claim 1, wherein:

said mattress includes at the head end a third set of cells comprising a plurality of adjacent cell groups which are connectable to a gas supply in a mode in which they are inflatable in unison with each other, while said first and second sets of cells are inflated and deflated cyclically in said predetermined sequence.

11. An alternating pressure mattress according to claim 10, wherein one or more of said cell groups of said third set includes a side forming cell.

* * * * *